US009174823B2

(12) United States Patent
Tokura

(10) Patent No.: US 9,174,823 B2
(45) Date of Patent: Nov. 3, 2015

(54) ELEVATOR SYSTEM WHICH SELECTS A GROUP CONTROLLER FROM A PLURALITY OF GROUP CONTROLLERS

(75) Inventor: Sakurako Tokura, Tokyo (JP)

(73) Assignee: Mitsubishi Electric Corporation, Tokyo (JP)

( * ) Notice: Subject to any disclaimer, the term of this patent is extended or adjusted under 35 U.S.C. 154(b) by 768 days.

(21) Appl. No.: 13/505,572

(22) PCT Filed: Dec. 11, 2009

(86) PCT No.: PCT/JP2009/006775

§ 371 (c)(1),
(2), (4) Date: May 2, 2012

(87) PCT Pub. No.: WO2011/070622

PCT Pub. Date: Jun. 16, 2011

(65) Prior Publication Data

US 2012/0228065 A1 Sep. 13, 2012

(51) Int. Cl.
*B66B 1/20* (2006.01)
*B66B 1/46* (2006.01)

(52) U.S. Cl.
CPC ..... *B66B 1/468* (2013.01); *B66B 2201/463* (2013.01); *B66B 2201/4615* (2013.01); *B66B 2201/4676* (2013.01)

(58) Field of Classification Search
CPC ..... B66B 5/0012; B66B 2201/223; B66B 2201/4615; B66B 2201/4676; B66B 2201/463; B66B 1/468
USPC ..... 187/247, 380–388, 391–393
See application file for complete search history.

(56) References Cited

U.S. PATENT DOCUMENTS 4,341,288 A 7/1982 Bass
4,685,538 A 8/1987 Kamaike
5,092,430 A * 3/1992 Goto et al. ..... 187/384
5,689,094 A 11/1997 Friedli et al.

(Continued)

FOREIGN PATENT DOCUMENTS

CN 1747885 A 3/2006
JP 8 81143 3/1996

(Continued)

OTHER PUBLICATIONS

International Search Report Issued May 18, 2010 in PCT/JP09/06775 Filed Dec. 11, 2009.

(Continued)

*Primary Examiner* — Anthony Salata
(74) *Attorney, Agent, or Firm* — Oblon, McClelland, Maier & Neustadt, L.L.P.

(57) ABSTRACT

A personal authentication device provided in a destination call registration device adapted to obtain authentication information from a user. The device includes an access control device adapted to, when the personal authentication device obtains the authentication information, obtain verification information including a plurality of pieces of permitted floor information corresponding to the authentication information and position information of the destination call registration device; and a supervisory controller adapted to determine, based on the verification information, whether a destination floor inputted into the destination call registration device is a permitted floor, and, based on the registration, control an elevator car.

1 Claim, 5 Drawing Sheets

(56) References Cited

U.S. PATENT DOCUMENTS

| | | | | |
|---|---|---|---|---|
| 5,749,443 | A * | 5/1998 | Romao | 187/384 |
| 6,793,044 | B2 * | 9/2004 | Koehler et al. | 187/382 |
| 7,025,180 | B2 * | 4/2006 | Wyss et al. | 187/383 |
| 7,145,433 | B2 * | 12/2006 | Gerstenkorn | 340/5.22 |
| 7,190,256 | B2 * | 3/2007 | Pieper | 340/5.7 |
| 7,328,775 | B2 * | 2/2008 | Zaharia et al. | 187/396 |
| 7,490,698 | B2 * | 2/2009 | Sirag, Jr. | 187/381 |
| 7,581,622 | B2 * | 9/2009 | Amano | 187/384 |
| 7,849,974 | B2 * | 12/2010 | Stanley et al. | 187/387 |
| 7,882,938 | B2 * | 2/2011 | Blackaby et al. | 187/388 |
| 7,936,249 | B2 * | 5/2011 | Friedli | 340/5.5 |
| 8,061,485 | B2 * | 11/2011 | Finschi | 187/384 |
| 8,151,943 | B2 * | 4/2012 | de Groot | 187/382 |
| 8,301,456 | B2 * | 10/2012 | Gazdzinski | 704/273 |
| 8,401,472 | B2 * | 3/2013 | Gerstenkorn | 455/41.2 |
| 8,413,766 | B2 * | 4/2013 | Friedli | 187/384 |
| 8,770,350 | B2 * | 7/2014 | Wilke et al. | 187/384 |
| 2001/0022252 | A1 | 9/2001 | Schuster | |
| 2008/0011557 | A1 | 1/2008 | Hakala et al. | |
| 2009/0020372 | A1 | 1/2009 | Amano | |
| 2010/0006379 | A1 | 1/2010 | Hamaji | |

FOREIGN PATENT DOCUMENTS

| | | |
|---|---|---|
| JP | 11-60085 A | 3/1999 |
| JP | 2004 250193 | 9/2004 |
| JP | 2005-96981 | 4/2005 |
| JP | 2006-117398 A | 5/2006 |
| JP | 2006 151580 | 6/2006 |
| JP | 2008 150208 | 7/2008 |
| WO | 2006 043324 | 4/2006 |
| WO | WO 2006/082273 | 8/2006 |
| WO | 2008 050416 | 5/2008 |

OTHER PUBLICATIONS

Office Action issued on Oct. 17, 2013 in the corresponding Chinese Patent Application No. 200980162783.0 (with Partial English Translation).

Japanese Office Action issued Jul. 30, 2013, in Japan Patent Application No. 2011-544984 (with partial English translation).

U.S. Appl. No. 13/510,326, filed May 17, 2012, Mitsuda, et al.

Chinese Office Action issued Mar. 12, 2014, in China Patent Application No. 200980162783.0 (with Partial English translation).

Office Action issued Nov. 5, 2013 in Japanese Patent Application No. 2011-544984 (with partial English translation).

European Search Report for European Patent Application No. 09852019.0 dated Sep. 3, 2015.

* cited by examiner fig. 1

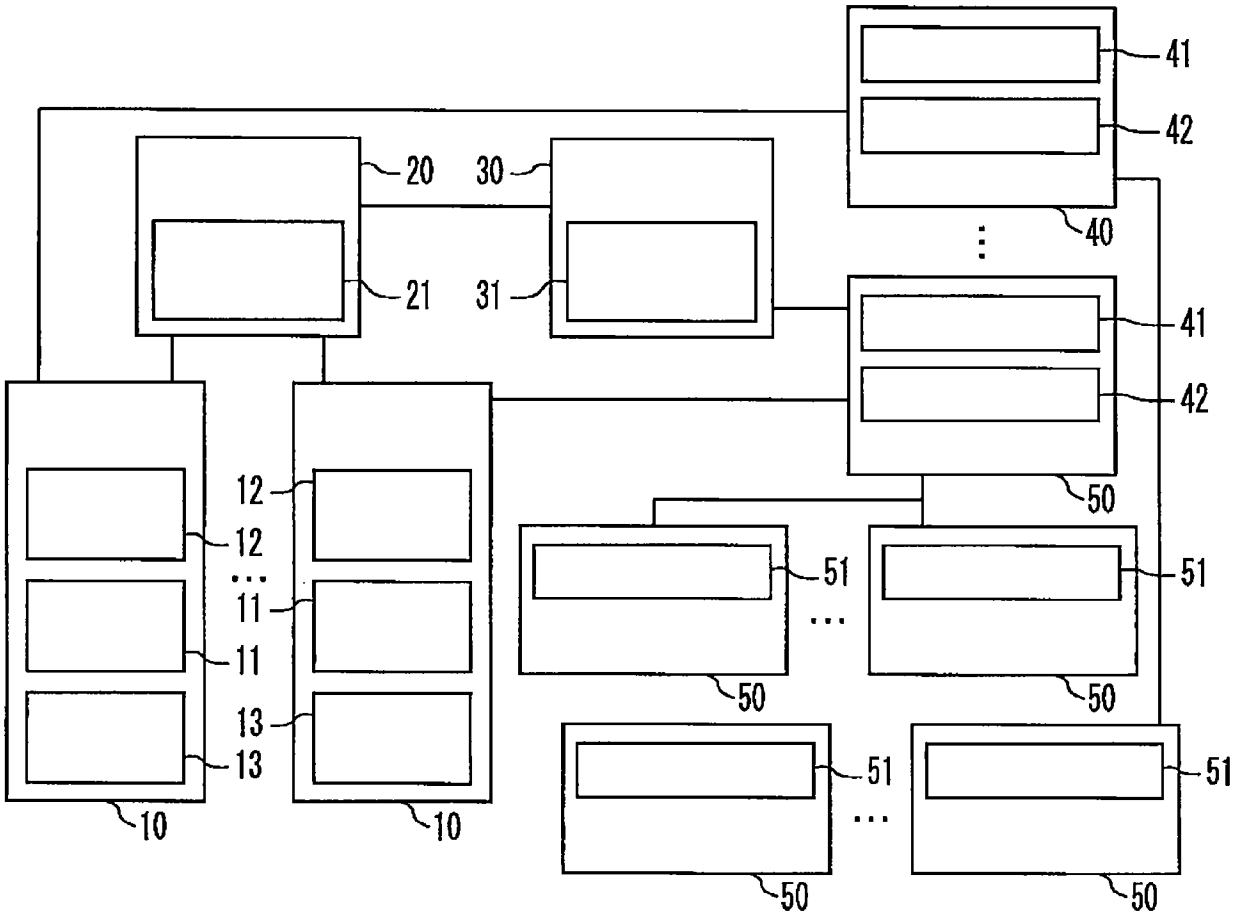

10: DESTINATION CALL REGISTRATION DEVICE
11: DESTINATION FLOOR INPUT DEVICE
12: ASSIGNED CAR SIGNALING DEVICE
13: PERSONAL AUTHENTICATION DEVICE
20: ACCESS CONTROL DEVICE
21: VERIFICATION INFORMATION TRANSMISSION FUNCTION
30: COMMUNICATION DEVICE
31: PERMITTED FLOOR INFORMATION TRANSMISSION FUNCTION
40: GROUP CONTROLLER
41: PERMITTED FLOOR CONTROL FUNCTION
42: ASSIGNMENT CONTROL FUNCTION
50: CAR CONTROLLER
51: ELEVATOR CAR CONTROL FUNCTION fig. 7

| PERMITTED FLOORS | GROUP 1 MANAGEMENT PERMITTED FLOORS | GROUP 2 MANAGEMENT PERMITTED FLOORS | ... | GROUP 5 MANAGEMENT PERMITTED FLOORS |
|---|---|---|---|---|
| 1ST FLOOR | — | 1ST FLOOR | | 1ST FLOOR |
| 2ND FLOOR | 1ST FLOOR | — | | 2ND FLOOR |
| 3RD FLOOR | 2ND FLOOR | — | | 3RD FLOOR |
| 4TH FLOOR | 3RD FLOOR | — | | 4TH FLOOR |
| 5TH FLOOR | 4TH FLOOR | 2ND FLOOR | | 5TH FLOOR |
| 6TH FLOOR | 5TH FLOOR | 3RD FLOOR | | — |
| 7TH FLOOR | 6TH FLOOR | 4TH FLOOR | | — |
| 8TH FLOOR | 7TH FLOOR | 5TH FLOOR | | — |

32

ELEVATOR SYSTEM WHICH SELECTS A GROUP CONTROLLER FROM A PLURALITY OF GROUP CONTROLLERS

TECHNICAL FIELD

The present invention relates to an elevator system for carrying out a call registration of a predetermined destination floor based on user's personal information before boarding.

BACKGROUND ART

In a conventional elevator system, for example, in the elevator system disclosed in Japanese Patent Laid-open No.08-81143, data identifying the user is automatically read from user's information transmitter to the elevator system at a hall, an elevator car is assigned based on this destination call and the destination floor is indicated to the user at the hall.

CITATION LIST

Patent Literature

Japanese Patent Laid-open No.08-81143

SUMMARY OF INVENTION

Technical Problem

However, in the conventional elevator system, user data is automatically read from an information transmitter, an elevator car is assigned and the destination floor is indicated to the user at a hall. The system, however, uniquely determines a destination floor in advance. Consequently, the elevator user can register only a specific floor call, and, in a case of registering a call for other floors, needs to prepare another information transmitter or carry out a call registration by another way. Therefore, it is not convenient for the users.

Means for Solving the Problems

The present invention is an elevator system which comprises a personal authentication device provided in a destination call registration device adapted to obtain authentication information from a user; an access control device adapted to, when the personal authentication device obtains the authentication information, obtain verification information comprised of a plurality of pieces of permitted floor information corresponding to the authentication information and position information of the destination call registration device; and a supervisory controller adapted to determine, based on the verification information, whether a destination floor inputted into the destination call registration device is a permitted floor, and, in the case of the permitted floor, move an elevator car to the destination floor.

Also, the present invention is an elevator system which comprises a personal authentication device provided in a destination call registration device adapted to obtain authentication information from a user; an access control device adapted to, when the personal authentication device obtains the authentication information, obtain verification information comprised of a plurality of pieces of permitted floor information corresponding to the authentication information and position information of the destination call registration device; a group controller adapted to determine, based on the verification information, whether a destination floor inputted into the destination call registration device is a permitted floor, and, in the case of the permitted floor, assigns one of multiple elevator cars; and a supervisory controller adapted to move the elevator car assigned by the group controller, to the destination floor.

Also, the present invention is an elevator system which comprises a personal authentication device provided in a destination call registration device adapted to obtain authentication information from a user; an access control device adapted to, when the personal authentication device obtains the authentication information, obtain verification information comprised of a plurality of pieces of permitted floor information corresponding to the authentication information and position information of the destination call registration device; and a communication device adapted to select one of group controllers based on the position information of the verification information and transmits the verification information, wherein the group controller determines, based on the verification information, whether a destination floor inputted into the destination call registration device is a permitted floor, and, in the case of the permitted floor, assigns one of multiple elevator cars.

Also, the present invention is an elevator system, in the above-described elevator system, wherein the communication device comprises floor transformation data associating floors managed by the access control device and floors managed by the group controller and transforms permitted floors of the verification information managed by the access control device into floors managed by the group controller and transmits transformed information to the group controller.

Advantageous Effect of Invention

The elevator system according to the present invention can present a plurality of predetermined destination floors to a user based on authentication information of the user, and therefore the user can carry out a destination call to a plurality of permitted floors, so that there is an advantage of ensuring the security in building use and implementing user-friendly destination call registration.

BRIEF DESCRIPTION OF THE DRAWINGS

FIG. 1 is the elevator system configuration related to Embodiment 1 of the present invention.

FIG. 7 is an example of floor transformation data related to Embodiment 2 of the present invention.

DESCRIPTION OF EMBODIMENTS

Embodiment 1

Figure 2:
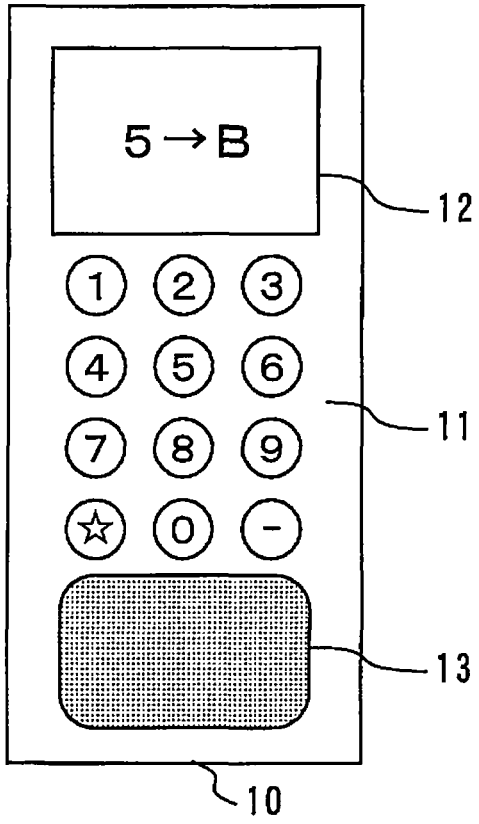
FIG. 2 is an example of a destination call registration device related to Embodiment 1 of the present invention.

An elevator system configuration in Embodiment 1 of the present invention will be explained using FIGS. 1 and 2. A reference numeral 10 denotes a destination call registration device provided at an elevator hall or a path connected to the hall. The destination call registration device 10 is provided with a destination floor input device 11 by which the user inputs a destination floor, an assigned car signaling device 12 for notifying an assigned car to the user, and a personal authentication device 13 for receiving user authentication information as input and authenticating the user.

Next, an example of the destination call registration device 10 will be shown using FIG. 2. Here, although the destination floor input device 11 will be explained as a device for inputting a destination floor by ten key buttons, the destination floor input device 11 is not limited to this and may be provided with each destination floor button. Also, although the registration device 10 of a button type will be explained, the registration device 10 of a touch panel type is possible.

Here, the assigned car signaling device 12 will be explained as a display for displaying an assigned car as shown in FIG. 2, the assigned car signaling device 12 is not limited to this and may be a speaker for guiding an assigned car by speech or a device combining a display and a speaker. It should be noted that "5→B" in the assigned car signaling device 12 illustrated in FIG. 2 stands for a message that "an elevator car to the fifth floor will reach B."

As shown in FIG. 2, the personal authentication device 13 may be a card reader for reading a card which is held by the user and in which the user's personal ID is registered, or may be a biometric identification device for reading the user's finger print, palm print, iris, and so on. Alternatively, the personal authentication device 13 may be a device combining a card reader and a biometric identification device. The personal authentication device 13 reads the user's personal ID from the card and transmits authentication information 60 of the personal ID to an access control device 20 (described later).

A reference numeral 20 denotes an access control device, which has a verification information transmission function 21 for receiving the authentication information 60 transmitted from the personal authentication device 13 of the destination call registration device 10 and transmitting verification information 70 corresponding to the personal ID based on this authentication information 60 to a communication device 30 (described later).

A reference numeral 30 denotes a communication device, which has a permitted floor information transmission function 31 for transmitting permitted floor information per person to a group controller 40 (described later) using the verification information 70 transmitted from the verification information transmission function 21 of the access control device 20. Here, the communication device 30 selects a group controller 40 from a plurality of group controllers 40 based on position information of the verification information 70. It should be noted that the verification information 70 and the permitted floor information are equivalent to each other in the present embodiment.

A reference numeral 40 denotes a group controller for supervising and controlling multiple elevator car groups (banks). The controller has a permitted floor control function 41 and assignment control function 42 (described later). It should be noted that an explanation will be given below using the plurality of group controllers 40.

The permitted floor control function 41 is provided to control a permitted floor per person. To be more specific, it has a function of permitting the destination call registration device 10 having carried out personal authentication to temporarily (e.g. ten seconds) register one of multiple destination floors of management permitted floors received from the communication device 30. Further, the permitted floor control function 41 has a function of determining whether the destination floor input in the destination call registration device is a permitted floor, based on the verification information. The assignment control function 42 has a function of determining an assigned car for the destination call registration in a case where the input destination floor is determined as a permitted floor.

It should be noted that, in a case of an elevator system not requiring multiple group supervisory controls, based on permitted floor information, the group controller 40 temporarily permits the destination call registration device 10 to register one of a plurality of permitted floors and assign one of a plurality of elevator cars based on the registration.

A reference numeral 50 denotes a car controller provided for every car, which has an elevator car control function 51.

It should be noted that, in a case of an elevator system not requiring multiple group supervisory controls, based on permitted floor information, the supervisory controller 50 temporarily permits the destination call registration device 10 to register one of a plurality of permitted floors. Further, the supervisory controller 50 has a function of determining whether the destination floor input in the destination call registration device is a permitted floor. Further, in a case where the destination floor is determined as a permitted floor, the supervisory controller 50 controls an elevator car based on the registration.

Figure 3:
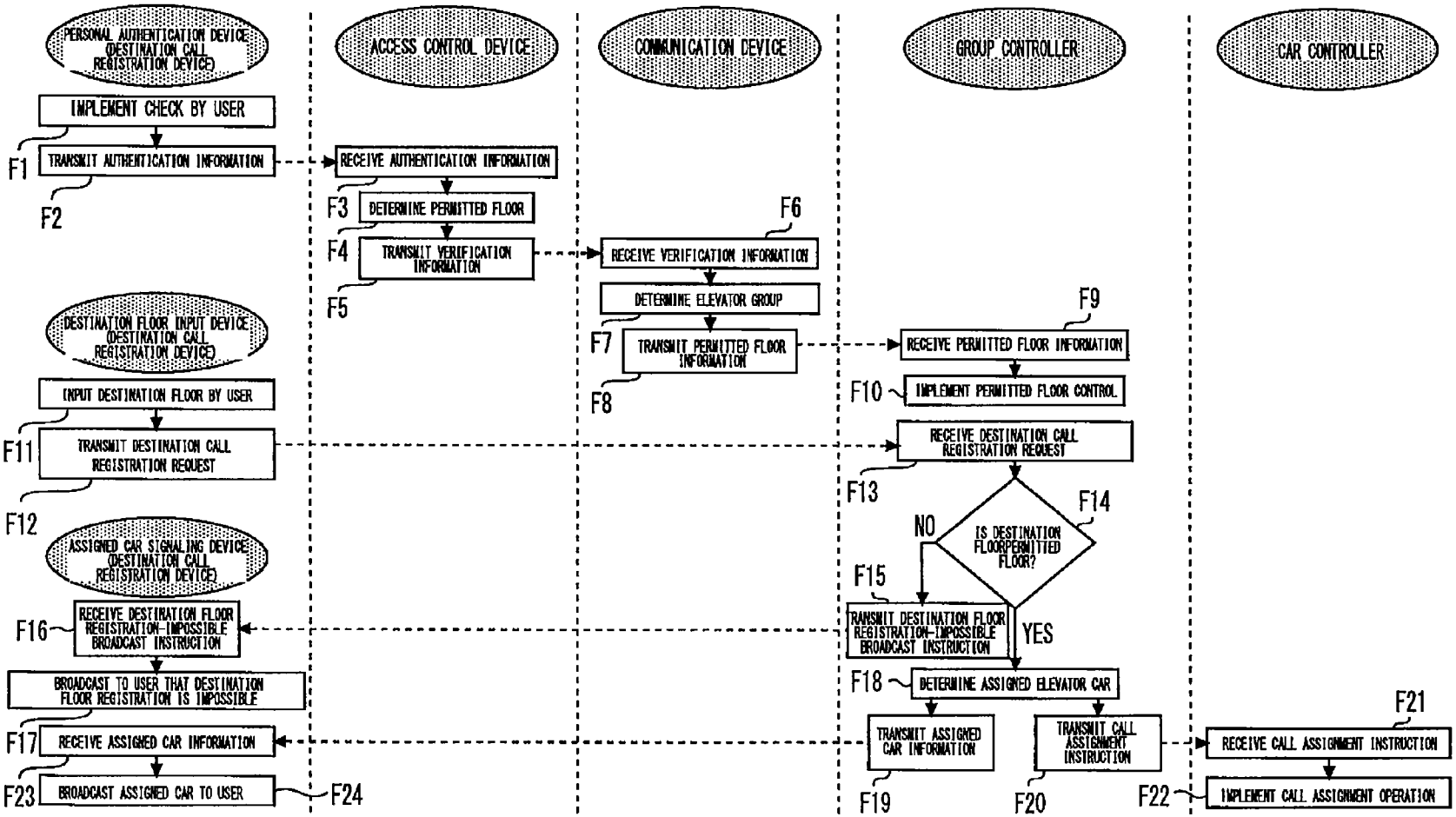
FIG. 3 is a process flowchart implemented in the elevator system related to Embodiment 1 of the present invention.
Figure 4:
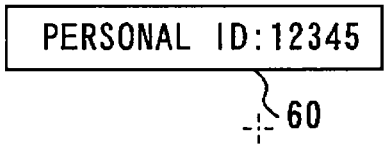
FIG. 4 is an example of authentication information related to Embodiment 1 of the present invention.
Figure 5:
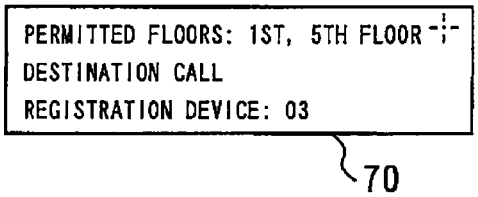
FIG. 5 is an example of verification information related to Embodiment 1 of the present invention.

Next, operations of the elevator system will be explained using FIGS. 3, 4 and 5. FIG. 3 is an implementation flowchart in Embodiment 1. When an elevator user implements personal authentication in the personal authentication device 13 provided in the destination call registration device 10 (F1), the authentication information 60 is transmitted from the personal authentication device 13 to the access control device 20 (F2). FIG. 4 shows the personal ID as an example of the authentication information 60.

When receiving the authentication information 60 from the personal authentication device 13 (F3), the access control device 20 determines multiple predetermined user's permitted floors based on the authentication information 60 (F4) and transmits the verification information 70 to the communication device 30 (F5), where the verification information 70 contains the plurality of permitted floors and position information corresponding to the position number of the destination call registration device 10 including the personal authentication device 13 having carried out the personal authentication of the user. FIG. 5 shows an example of the verification information 70.

When receiving the verification information 70 from the access control device 20 (F6), the communication device 30 determines an elevator car (bank) to register a destination call based on the position information of the destination call registration device 10 (F7). Next, the communication device 30 transmits permitted floor information recording the position number of the destination call registration device 10 and the permitted floors, to the group controller 40 that manages the determined elevator car group (F8).

The communication device 30 has a list of the group controllers 40 associated with the position information of the destination call registration device 10 and determines the group controller 40 based on the position information using the list.

It should be noted that an explanation will be given below with the assumption that there are a plurality of elevator car groups, but, in a case where there are only one elevator car group and only one group controller 40, the communication device 30 may transmit the permitted floor information to the group controller 40 or the access control device 20 may transmit the verification information 70 to the group controller 40.

Also, in an elevator system in which the group controller 40 is not necessary because the elevator car group is not provided, the communication device 30 may transmit the permitted floor information to the supervisory controller 50 or the access control device 20 may transmit the verification information 70 to the supervisory controller 50.

When receiving the permitted floor information from the communication device 30 (F9), the permitted floor control function 41 of the group controller 40 determines, from the position information of the destination call registration device 10, the destination call registration device 10 to implement permitted floor control and implements permission control of the destination call registration device 10 (F10).

To be more specific, the permitted floor control function 41 temporarily permits a plurality of destination floor registrations from the destination call registration device 10 that carries out personal authentication, with respect to the management permitted floors in the verification information 70. For example, when receiving verification information of "permission management floors: first floor and fifth floor, destination call registration device: 03" from the communication device 30, the permitted floor control function 41 temporarily (e.g. ten seconds) permits a destination floor registration to the first or fifth floor from the destination call registration 10 of destination call registration device "03" of position information. It should be noted that, while the destination floor registration is temporarily permitted, it may be possible to present to the user the floors at which the destination floor registration is permitted, and prompt the user to input a destination floor in the destination floor input device 11.

If the user inputs a destination floor in the destination floor input device 11 of the destination call registration device 10 while the permitted floor control function 41 implements permitted floor control (F11), the destination floor input device 11 transmits a destination call registration request to the group controller 40 (F12). When receiving the destination call registration request from the destination floor input device 11 (F13), with reference to the permitted floor information, the group controller 40 determines whether the destination floor is included in the plurality of floors at which call registration is permitted (F14). If the destination floor is a floor at which call destination is not permitted, the group controller 40 transmits a destination floor registration-impossible broadcast instruction to the destination call registration device 10 (F15).

When receiving the destination floor registration-impossible broadcast instruction (F16), the assigned car signaling device 12 of the destination call registration device 10 broadcasts to the user that the input destination floor is a floor at which destination call registration is not permitted (F17).

In a case of a destination floor at which call registration is permitted, the assignment control function 42 of the group controller 40 determines an assigned elevator car from elevator car groups (F18). Here, in the determination of the assigned elevator car from the elevator car groups by the assignment control function 42, although the assigned elevator car is determined such that the passengers of the same destination floor get in the elevator car as much as possible, the present invention is not limited to this and it is equally possible to determine an elevator car in other viewpoints.

Next, assigned car information is transmitted to the assigned car signaling device 12 (F19) and a call assignment instruction is transmitted to car controller 50 (F20). When receiving the call assignment instruction from the group controller 40 (F21), car controller 50 implements a call assignment operation (F22). Further, when receiving the assigned car information from the group controller 40, the assigned car signaling device 12 broadcasts the assigned car to the user (F24).

According to Embodiment 1, by presenting multiple permitted floors based on the verification information 70 to the user and permitting a destination call of multiple floors to the user, there is an advantage of ensuring the security and implementing user-friendly destination call registration.

Embodiment 2

In Embodiment 1, an explanation has been given with the assumption that the verification information 70 transmitted from the access control device 20 to the communication device 30 and the permitted floor information transmitted from the communication device 30 to the group controller 40 are equivalent. That is, an explanation has been given with the assumption that the floor setting managed by the access control device 20 and the floor setting managed by the group controller 40 are equivalent. However, an explanation will be given in the present embodiment, where the floor setting managed by the access control device 20 and the floor setting managed by the group controller 40 are not equivalent.

The elevator manages only stopped floors every elevator car group and therefore the floors managed by elevator car groups are different from floors recognized by the user. To be more specific, shown in FIG. 7 is an eight-story building as a whole. However, since an elevator car of an elevator car group 1 stops between the second floor and the eighth floor, the group controller 40 of the elevator group 1 handles seven stops. Similarly, an elevator car of an elevator car group 2 stops the first floor and between the fifth floor and the eighth floor, and therefore the group controller 40 of the elevator group 2 handles five stops. Further, an elevator car of an elevator car group 3 stops between the first floor and the fifth floor, and therefore the group controller 40 of the elevator group 3 handles five stops.

Figure 6:
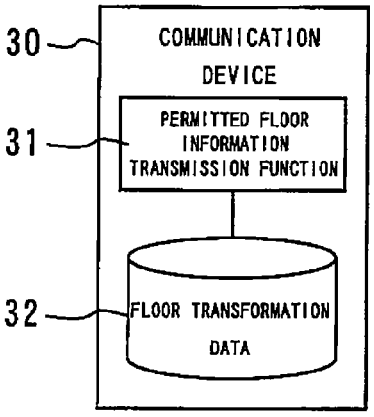
FIG. 6 is a configuration of a communication device related to Embodiment 2 of the present invention.

Therefore, as shown in FIG. 6, the communication device 30 is provided with floor transformation data 32, and the permitted floor information transmission function 31 of the communication device 30 transforms permitted floors and transmits permitted floor information. The communication device 30 is provided with floor transformation data 32 associating the floors managed by the access control device with the floors managed by the group controller, where permitted floors of the verification information managed by the access control device are transformed into the floors managed by the group controller. Further, the communication device 30 is provided with the permitted floor information transmission function, where the verification information 70 is transmitted as permitted floor information to the group controller.

That is, the access control device 20 controls the whole building and therefore manages floors in the whole building. However, the group controller 40 manages only specific elevator car groups and therefore the managed floor settings may be different. Consequently, using the floor transformation data 32 as shown in FIG. 7, the communication device 30 transforms permitted floors, which are recorded in the authentication information 70 received from the access control device 20, into management permitted floors corresponding to the floor setting of each elevator car group and then transmits permitted floor information to the group controller 40.

According to this Embodiment 2, even in a case where the floor setting managed by the access control device and the floor setting managed by the group controller are not equivalent, there is an advantage that the group controller can adequately control permitted floors.

INDUSTRIAL APPLICABILITY

The present invention relates to an elevator system.

DESCRIPTION OF SYMBOLS

10 destination call registration device
11 destination floor input device
12 assigned car signaling device
13 personal authentication device
20 access control device
21 verification information transmission function
30 communication device
31 permitted floor information transmission function
32 floor transformation data
40 group controller
41 permitted floor control function
42 assignment control function
50 car controller
51 elevator car control function
60 authentication information
70 verification information

The invention claimed is:

1. An elevator system comprising:

a personal authentication device provided in a destination call registration device to obtain authentication information from a user;

an access control device to, when the personal authentication device obtains the authentication information, obtain verification information comprised of a plurality of pieces of permitted floor information corresponding to the authentication information and position information of the destination call registration device; and a communication device to select one of group controllers based on the position information of the verification information and transmit the verification information, wherein the group controller determines, based on the verification information, whether a destination floor inputted into the destination call registration device is a permitted floor, and, in the case of the permitted floor, assigns one of multiple elevator cars, wherein:

the communication device comprises floor transformation data associating floors managed by the access control device and floors managed by the group controller and transforms permitted floors of the verification information managed by the access control device into floors managed by the group controller and transmits transformed information to the group controller.

* * * * *